US010138785B2

(12) United States Patent
Hiltunen et al.

(10) Patent No.: US 10,138,785 B2
(45) Date of Patent: Nov. 27, 2018

(54) ARRANGEMENT FOR AND METHOD OF FEEDING AMMONIA CONTAINING FLUID INTO THE EXHAUST GAS PASSAGE OF A COMBUSTION PLANT

(71) Applicant: Sumitomo SHI FW Energia Oy, Espoo (FI)

(72) Inventors: Teri Hiltunen, Leppävirta (FI); Jouni Lantto, Oulu (FI)

(73) Assignee: Sumitomo SHI FW Energia Oy, Espoo (FI)

( * ) Notice: Subject to any disclaimer, the term of this patent is extended or adjusted under 35 U.S.C. 154(b) by 262 days.

(21) Appl. No.: 14/891,736

(22) PCT Filed: May 29, 2015

(86) PCT No.: PCT/FI2015/050376

§ 371 (c)(1),
(2) Date: Nov. 17, 2015

(87) PCT Pub. No.: WO2015/185798

PCT Pub. Date: Dec. 10, 2015

(65) Prior Publication Data

US 2018/0119590 A1 May 3, 2018

(30) Foreign Application Priority Data

Jun. 4, 2014 (FI) ..... 20145511

(51) Int. Cl.
*F01N 3/00* (2006.01)
*F01N 3/20* (2006.01)
*F01N 3/10* (2006.01)

(52) U.S. Cl.
CPC ..... *F01N 3/208* (2013.01); *F01N 3/10* (2013.01); *F01N 2610/01* (2013.01);
(Continued)

(58) Field of Classification Search
CPC .... F01N 3/10; F01N 2610/01; F01N 2610/02; F01N 3/208
(Continued)

(56) References Cited

U.S. PATENT DOCUMENTS 4,756,890 A 7/1988 Tang et al.
5,342,592 A 8/1994 Peter-Hoblyn et al.
(Continued)

FOREIGN PATENT DOCUMENTS

CN 202538632 U 11/2012
DE 10 2011 016 967 A1 10/2012
(Continued)

OTHER PUBLICATIONS

Russian Decision on Grant dated Jan. 19, 2017, issued in corresponding Russian Patent Application No. 2015156462/06(087043), with an English translation.
(Continued)

*Primary Examiner* — Jason Shanske
(74) *Attorney, Agent, or Firm* — Fitzpatrick, Cella, Harper & Scinto

(57) ABSTRACT

An arrangement for feeding ammonia containing fluid into an exhaust gas passage of a combustion plant includes a first fluid line connectable in flow connection with a source of an ammonia containing fluid. A second fluid line is in flow connection with a source of a dilution fluid. A control unit controls multiple valve members of a valve unit, each of the valve members having a first inlet in flow connection with the first fluid line, a second inlet in flow connection with the second fluid line and an outlet in flow connection with an outlet channel connected to the exhaust gas passage. The valve members are connected in parallel so that the outlet of each of the valve members is in flow connection with a common outlet channel.

15 Claims, 2 Drawing Sheets

(52) U.S. Cl.
CPC ..... *F01N 2610/02* (2013.01); *F01N 2610/14* (2013.01); *F01N 2610/1493* (2013.01)

(58) Field of Classification Search
USPC ..... 60/285
See application file for complete search history.

(56) References Cited

U.S. PATENT DOCUMENTS

| | | | | |
|---|---|---|---|---|
| 5,462,718 | A | 10/1995 | Abdulally | |
| 5,820,838 | A | 10/1998 | Tsuo et al. | |
| 8,661,785 | B2 | 3/2014 | Levin et al. | |
| 9,089,817 | B2 | 7/2015 | Lee et al. | |
| 9,322,314 | B2 | 4/2016 | Hodgson et al. | |
| 2010/0154690 | A1 | 6/2010 | Halter | |
| 2011/0232267 | A1 | 9/2011 | Brück | |
| 2012/0299205 | A1 | 11/2012 | Lee et al. | |
| 2013/0101472 | A1* | 4/2013 | Lee | F01N 3/2066 422/168 |

FOREIGN PATENT DOCUMENTS

| | | | |
|---|---|---|---|
| EP | 2 583 740 | A2 | 4/2013 |
| GB | 1 514 529 | | 6/1978 |
| JP | H05-055547 | U | 7/1993 |
| RU | 2012 114 890 | A | 10/2013 |
| WO | 91/17814 | A1 | 11/1991 |
| WO | 93/19837 | A1 | 10/1993 |

OTHER PUBLICATIONS

Japanese Official Action dated Jul. 13, 2016, issued in corresponding Japanese Patent Application No. 2015-563156, with an English translation.
Finnish Office Action dated Jan. 21, 2015, issued in counterpart Finnish Patent Application No. 20145511.
Finnish Patent and Registration Office Search Report dated Jan. 21, 2015, issued in counterpart Finnish Patent Application No. 20145511.
Notification of and International Search Report and Written Opinion dated Oct. 2, 2015, in counterpart International Application No. PCT/FI2015/050376.

* cited by examiner

ARRANGEMENT FOR AND METHOD OF FEEDING AMMONIA CONTAINING FLUID INTO THE EXHAUST GAS PASSAGE OF A COMBUSTION PLANT

CLAIM OF PRIORITY

This application is a U.S. national stage application of PCT International Application No. PCT/FI2015/050376, filed May 29, 2015, which claims priority from Finnish patent application number 20145511, filed Jun. 4, 2014.

BACKGROUND OF THE INVENTION

Field of the Invention

The present invention relates to an arrangement for and a method of feeding ammonia containing fluid into an exhaust gas passage of a combustion plant. More particularly, the present invention relates to feeding ammonia containing fluid into an exhaust gas passage of a combustion plant comprising a first fluid line connectable in flow connection with a source of an ammonia containing fluid, a second fluid line in flow connection with a source of a dilution fluid, and a control unit for controlling multiple valve members, each of the valve members having a first inlet in flow connection with the first fluid line, a second inlet in flow connection with the second fluid line, and an outlet in flow connection with the exhaust gas passage.

Description of Related Art

Reduction of nitrogen oxide ($NO_x$) emissions from exhaust gases, before they are released into the atmosphere, has been a prolific topic of discussion in the field of environmental aspects of energy production by combustion of fuel material. Because $NO_x$ emissions are related to various environmental problems, the minimizing of $NO_x$ release from combustion plants is an ongoing concern.

A generally used method to reduce $NO_x$ levels in exhaust gases is introducing reducing agent such as ammonia or ammonia precursor into the exhaust gases. Different locations for injecting reducing agents, particularly ammonia, have been suggested, for example, in U.S. Pat. No. 5,820,838, U.S. Pat. No. 5,462,718, U.S. Pat. No. 4,756,890, and U.S. Pat. No. 5,342,592, and in published GB Patent Document No. 1 514 529. These documents suggest introducing reagent into the furnace, into a channel between the furnace and a particle separator, into the particle separator or into an exhaust gas duct.

Published International Patent Document WO 91/17814 A1 suggests injecting, for example, a mixture of ammonia and water as fine droplets of liquid dispersed in a gaseous component, such as air, into the exhaust gas at a sonic velocity to achieve a distribution of particles of sizes effective to uniformly reduce NOx within a zone of effective temperature.

U.S. Patent Application Publication No. US 2010/0154690 A1 discloses a method of injecting reducing agent, such as ammonia, into a boiler of a garbage incineration plant using a gaseous propellant, such as steam or air. The reducing agent and the propellant are combined in a distributor, from where they are conducted in desired quantities via multiple injection lines and respective nozzles into the boiler.

A problem with ammonia based reagents can be the blocking of the nozzles or other devices through which the ammonia is fed. In some cases, the combustion process needs to be stopped while the nozzles are cleaned. It may also be difficult to control the flow of ammonia so as to efficiently reduce $NO_x$ emissions without causing harmful ammonia slip in different combustion conditions, for example, in different load conditions or when using varying fuels.

An object of the present invention is to provide an arrangement for and a method of feeding ammonia containing fluid into an exhaust gas passage of a combustion plant, in which at least a portion of the above mentioned problems of prior art are minimized.

SUMMARY OF THE INVENTION

According to an aspect, the present invention provides an arrangement for feeding ammonia containing fluid into an exhaust gas passage of a combustion plant comprising a first fluid line connectable in flow connection with a source of an ammonia containing fluid, a second fluid line in flow connection with a source of a dilution fluid, and a control unit for controlling multiple valve members, each of the valve members having a first inlet in flow connection with the first fluid line, a second inlet in flow connection with the second fluid line, and an outlet in flow connection with the an outlet channel connected to the exhaust gas passage. It is characteristic to the invention that the valve members are connected in parallel so that each of the valve members is in flow connection with a common outlet channel. The control unit is adapted for controlling each of the valve members to maintain open flow path from either the first inlet or the second inlet to the outlet so as to feed a flow of either the ammonia containing fluid or the dilution fluid via the valve member to the common outlet channel.

According to another aspect, the present invention provides a method of feeding ammonia containing fluid into an exhaust gas passage of a combustion plant comprising the steps of introducing ammonia containing fluid from a source of an ammonia containing fluid into a first fluid line, introducing dilution fluid from a source of a dilution fluid into a second fluid line, and controlling multiple valve members with a control unit, each of the valve members having a first inlet in flow connection with the first fluid line, a second inlet in flow connection with the second fluid line, and an outlet in flow connection with an outlet channel connected to the exhaust gas passage. It is characteristic to the method that the valve members are connected in parallel so that each of the valve members is in flow connection with a common outlet channel, and by the step of controlling each of the valve members by the control unit to maintain open flow path from either the first inlet or the second inlet to the outlet so as to feed a flow of either the ammonia containing fluid or the dilution fluid via the valve member to the common outlet channel.

A main feature of the present invention is that, during the operation of the combustion plant, a continuous, preferably, substantially constant, flow of fluid is conveyed through the feeding arrangement, and more specifically, through each of the valve members. Depending on the state of the feeding arrangement, a stream of either the ammonia containing fluid or the dilution fluid flows through each of the valve members. When the streams from the individual valve members are combined in the common outlet channel, a continuous, preferably, substantially constant, flow of fluid is formed. The combined fluid stream is then injected into the exhaust gas passage, whereby a continuous stream of fluid flows through the feeding arrangement, but the concentration of ammonia containing fluid in the combined fluid stream is varied.

Hence, the present invention offers a new solution for feeding ammonia containing fluid into an exhaust gas passage of a combustion plant. The method of feeding ammonia containing fluid comprises controlling the multiple valve members so as to control the ratio of the flow of the ammonia containing fluid and the flow of the dilution fluid in the common outlet channel. The invention provides a precise and a reliable way to control the amount of ammonia containing fluid to be injected to the exhaust gas passage. More specifically, the invention provides a way to control the amount of ammonia containing fluid by controlling the concentration of the ammonia containing fluid in a continuous, preferably, substantially constant, flow of fluid injected to the exhaust gas passage. In addition, because there is a continuous flow of liquid through the system and through each of the valve members, the risk of blocking of the system, or any portion of the system, is considerably reduced.

According to a preferred embodiment of the present invention, each of the multiple valve members comprises a three-way valve. Thereby, the first inlet of each of the three-way valves is in flow connection with the first fluid line, the second inlet of each of the three-way valves is in flow connection with the second fluid line, and the outlet of each of the three-way valves is in flow connection with the common outlet channel connected to the exhaust gas passage.

Each of the multiple valve members has advantageously a specific throughput. Thereby, a predefined flow of either the ammonia containing fluid or the dilution fluid is continuously fed through each of the multiple valve members to the exhaust gas passage. More specifically, when each of the fluids is at a predetermined pressure, the specific throughput determines the flow of either the ammonia containing fluid or the dilution fluid through the valve member. According to a preferable embodiment of the present invention, each of the first and second fluid lines is provided with a pump to maintain a predetermined fluid pressure in the first and second fluid lines, respectively.

Generally, the specific throughputs of individual valve members of the multiple valve members can be identical, but advantageously, the specific throughputs differ from each other. According to a preferred embodiment of the present invention, each of the multiple valve members in a feeding arrangement has a different specific throughput. According to an especially preferred embodiment of the present invention, the arrangement comprises N valve members numbered as 1, 2, 3, . . . , N, and having relative specific throughputs as 1, 2, 4, . . . , $2^{(N-1)}$.

If N is, for example, 5, the relative specific throughputs are then 1, 2, 4, 8, and 16. If the relative throughputs represent fluid flows in liters/hour (l/h), the total combined flow is 31 l/h. The total flow of fluid consists of a flow amounting to any integer M from 0 to 31 l/h of the ammonia containing fluid. The rest of the flow, amounting to 31−M l/h, is then of the dilution fluid. In the above described example, the resolution of the flow control is 1 l/h. Naturally, the resolution can be freely selected based, for example, on the size of the plant. Thus, the resolution can be, for example, 0.5 l/h or 2 l/h.

According to a preferred embodiment of the present invention, the ammonia containing fluid is ammonia solution in water, having an ammonia concentration of 0%-25%, and the dilution fluid is water. Typically, the ammonia containing fluid is 25% ammonia solution in water, whereby the feeding arrangement according to the present invention provides a solution of ammonia in water in a controllable concentration of 0%-25%. The ammonia containing fluid can alternatively be another $NO_x$ reducing agent, such as urea solution in water or ammonia solution also containing other chemicals.

When using the present invention, typically, an additional amount of dilution fluid, such as water, is injected into the exhaust gas passage. However, the maximum amount of dilution fluid fed into the exhaust gas passage in any condition is only as much as the maximum amount of ammonia containing fluid to be fed into the exhaust gas passage. Therefore, it is possible to select the fluid feeding amount and the dilution fluid, such as water, so that the dilution fluid does not cause any harm to the combustion process.

On the other hand, the dilution fluid provides the advantage of acting as a carrier to the ammonia. Due to the fact that the total fluid flow is at least substantially constant, the penetration and distribution of the ammonia containing fluid into the exhaust gas passage is substantially unchanged, even when the amount of ammonia fed into the passage changes. Therefore, good distribution of ammonia can be obtained in any conditions, even when the need for ammonia is relatively low. Thus, feeding of surplus ammonia, which would bind to the fly ash and/or cause harmful ammonia slip to the environment, can be minimized. It is, in some cases, also possible to design the injection nozzles and feeding procedure without using a gaseous propellant, such as steam or air.

By using the present invention, the ratio of the amount of the ammonia containing fluid injected into the exhaust gas, and the ratio of the flows of the ammonia containing fluid and the dilution fluid, can be efficiently controlled, for example, based on the combustion conditions or load conditions of the combustion plant.

According to an embodiment of the present invention, a connection device that provides the ability to temporarily arrange the first fluid line in flow connection with the source of dilution fluid is arranged between the first and second fluid lines. The connection device enables cleaning the first fluid line by the dilution fluid by temporarily arranging the first fluid line in flow connection with the source of dilution fluid. More particularly, when the dilution fluid is allowed to flow into the first fluid line, the dilution fluid will clean the first fluid line, the first inlet of the multiple valve members, and the outlet of the multiple valve members.

This procedure provides an efficient way to maintain the first fluid line clean and to reduce the erosion or blocking due to the ammonia containing fluid. The cleaning, or in other words, the flushing, of the first fluid line, the first inlet of the multiple valve members and the outlet of the multiple valve members may be arranged based on predetermined timing periods. The cleaning may also be arranged to react to changing operational loads of the combustion plant so as to prevent blocking.

The connection device enabling to temporarily arrange the first fluid line in flow connection with the source of dilution fluid advantageously comprises a three-way valve arranged in the first fluid line. The three-way valve is then generally arranged so that an upstream portion of the first fluid line is in flow connection with a first inlet of the three-way valve, the second fluid line is in flow connection with a second inlet of the three-way valve and a downstream portion of the first fluid line is in flow connection with an outlet of the three-way valve.

The connection device may be connected to the first fluid line either upstream of the pump arranged in the first fluid line or between the pump and the multiple valve members. It is also possible to have two connection devices, one upstream of the pump and the second one between the pump and the multiple valve members. The connection device between the pump and the multiple valve members can be particularly used for cleaning the downstream portions of the first fluid line and the first inlets of the multiple valve members by the dilution fluid. The connection device upstream of the pump also can correspondingly be used for cleaning the pump and upstream portions of the first fluid line.

According to an embodiment of the present invention, the control unit is part of a distributed control system (DCS). Then, there is no need for local operation to control the $NO_x$ reduction, but the control unit, and the operation of each of the valve members, can be controlled remotely by the DCS.

According to an aspect, the present invention provides a combustion plant comprising at least one arrangement for feeding ammonia containing fluid into an exhaust gas passage of the combustion plant, as described in the embodiments above. The combustion plant can be, for example, a fluidized bed boiler, such as a circulating fluidized bed boiler or a bubbling bed boiler, a PC boiler, or an incinerator.

Typically, a combustion plant comprises more than one arrangement for feeding ammonia, as described above. Generally, such arrangements feed ammonia containing fluid into different portions of the exhaust gas passage. For example, a circulating fluidized bed boiler may comprise separate arrangements for feeding ammonia into an upper portion of a furnace, a channel between the furnace and a particle separator, a particle separator, and an exhaust gas passage downstream of the particle separator.

Multiple ammonia feeding arrangements may advantageously have common sources of ammonia containing fluid and dilution fluid, common first and second fluid lines, which branch off to the individual feeding arrangements, and common pumps for maintaining a predetermined fluid pressure in the first and second fluid lines. Each branch of the first fluid line advantageously comprises its own connection to the second fluid line, to clean the respective feeding arrangement, as described above. This arrangement provides the advantage that, for example, one ammonia feeding arrangement can be cleaned at the time when other ammonia feeding arrangements are in operation. However, there may also be a connection device upstream of a common pump to enable simultaneous cleaning of all of the multiple ammonia feeding arrangements. Alternatively, it is possible that multiple ammonia feeding arrangements are independent in the sense that they have, for example, their own sources of ammonia containing fluid, possibly, of different ammonia containing fluids.

The above brief description, as well as further objects, features, and advantages of the present invention will be more fully appreciated by reference to the following detailed description of the currently preferred, but nonetheless illustrative, embodiments in accordance with the present invention, when taken in conjunction with the accompanying drawings.

DETAILED DESCRIPTION OF THE INVENTION

Figure 1:
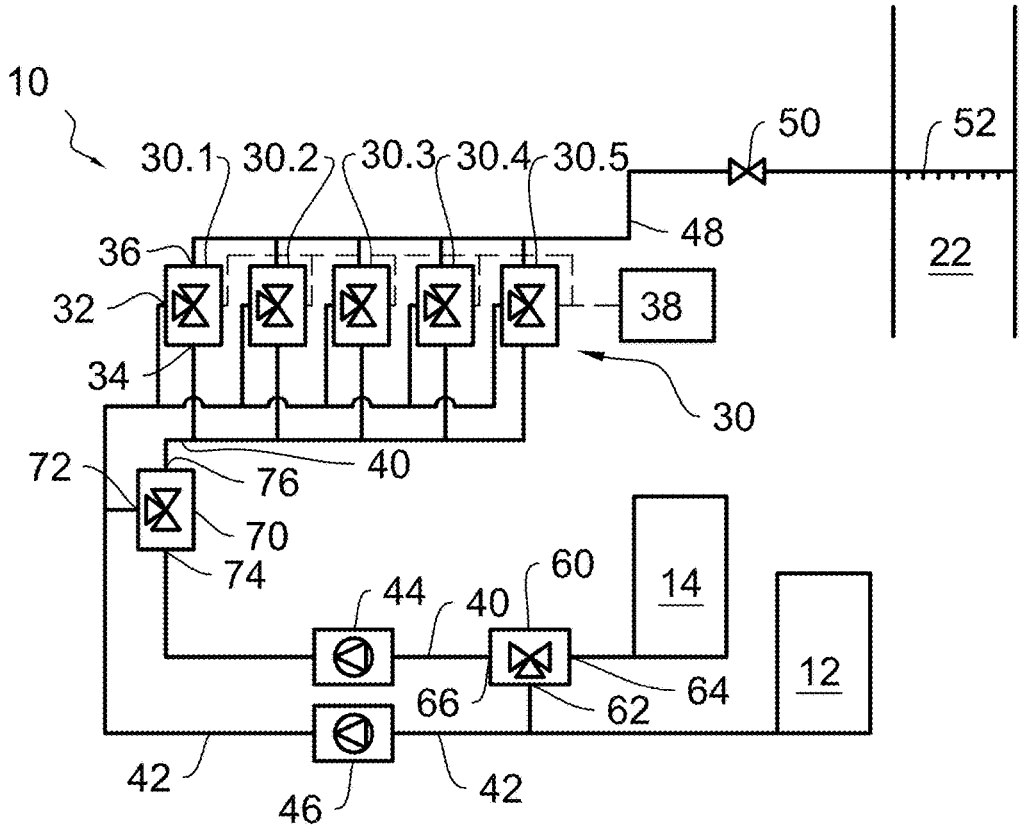
FIG. 1 schematically illustrates an arrangement for feeding ammonia containing fluid into an exhaust gas passage of a combustion plant according to an embodiment of the invention.

The schematic diagram of FIG. 1 illustrates an arrangement 10 for feeding ammonia containing fluid into an exhaust gas passage 22 of a combustion plant according to the invention. The arrangement 10 comprises a first fluid line 40 in flow connection with a source of an ammonia containing fluid 14 and a second fluid line 42 in flow connection with a source of a dilution fluid 12 which can be, for example, water. The ammonia containing fluid is typically ammonia solution in water, wherein the ammonia concentration is preferably between 0%-25%, or even more preferably, substantially 25%. The arrangement 10 further comprises a control unit 38 for controlling multiple valve members 30.1, 30.2, 30.3, 30.4, 30.5 of a valve unit 30. The multiple valve members 30.1, 30.2, 30.3, 30.4, 30.5 are connected in parallel so that each of the valve members has a first inlet 34 in flow connection with the first fluid line 40, a second inlet 32 in flow connection with the second fluid line 42 and an outlet 36 in flow connection with a common outlet channel 48, which is connected to the exhaust gas passage 22.

The control unit 38 is adapted for controlling each of the valve members 30.1, 30.2, 30.3, 30.4, 30.5 to maintain an open flow path only from one of the inlets, i.e., either from the first inlet 34 or from the second inlet 32, to the outlet 36. Thereby, a flow of either the ammonia containing fluid or the dilution fluid is fed via the valve member to the common outlet channel 48 and to the exhaust gas passage 22. Advantageously, each of the multiple valve members 30.1, 30.2, 30.3, 30.4, 30.5 is a three-way valve.

The multiple valve members 30.1, 30.2, 30.3, 30.4 and 30.5 can have different specific, or nominal, throughputs. This means that, assuming that the ammonia containing fluid and the dilution fluid are at a predetermined pressure, each of the multiple valve members feeds a predefined flow of ammonia containing fluid or dilution fluid via the valve member to the exhaust gas passage 22. In one embodiment, each of the multiple valve members 30.1, 30.2, 30.3, 30.4 and 30.5 has a different specific throughput. For example, the first, second, third, fourth, and fifth valve member 30.1, 30.2, 30.3, 30.4 and 30.5 have, respectively, throughputs of 1, 2, 4, 8 and 16 l/h. Thereby, the multiple valve members control the ratio of the flow of the ammonia containing fluid and the flow of the dilution fluid in the common outlet channel 48, but the total flow of fluid through the valve members, and through the common outlet channel 48, is always 31 l/h.

As an example, assuming that the conditions require, based on experience or specific measurements, that ammonia containing fluid is to be fed to the exhaust gas passage at a rate of 3 l/h. Then, the first valve member 30.1 is controlled to open a flow path from the first fluid line 40 to the outlet channel 48. Thereby, the first valve member provides a flow of 1 l/h of ammonia containing fluid to the outlet channel 48. Correspondingly, the second valve member 30.2 is controlled to open a flow path from the first fluid line 40 to the outlet channel 48, and thus, it provides a flow of 2 l/h of ammonia containing fluid to the outlet channel 48. At the same time, the third, fourth, and fifth valve members 30.3, 30.4 and 30.5 are controlled to open a flow path from the second fluid line to the outlet channel 48, a provide a total flow of 28 l/h of dilution fluid to the outlet channel. In this described example, the resolution of the flow control is 1 l/h. Naturally, the resolution can be freely selected based, for example, on the size of the plant. Thus, the resolution can be, for example, 0.5 l/h or 2 l/h.

The common outlet channel 48 is advantageously provided with an outlet valve 50, preferably, an on-off valve, which will open or close the flow path to the exhaust gas passage 22. The end portion of the outlet channel 48, within the exhaust gas passage 22, is advantageously provided with multiple injection devices, such as conventional spray nozzles 52, so as to efficiently distribute the mixture of ammonia containing fluid and dilution fluid into exhaust gas flowing in the exhaust gas passage 22. Ammonia acts as a reducing agent for the nitrogen oxides $NO_x$.

The first fluid line 40 may be provided with a pump 44 to maintain a predetermined pressure of the fluid ammonia containing fluid in the first fluid line 40. Similarly, the second fluid line 42 may be provided with a pump 46 to maintain a predetermined pressure of the dilution fluid in the second fluid line 42.

Between the first and second fluid lines 40, 42 is advantageously arranged connection devices 60, 70 providing the ability to temporarily arrange the first fluid line 40 in flow connection with the source of the dilution fluid 12. Advantageously, the connection devices comprise a three-way valve 60, 70 arranged in the first fluid line 40 so as to have an upstream portion of the first fluid line 40 in fluid connection with a first inlet 64, 74 of the three-way valve, the second fluid line 42 in fluid connection with a second inlet 62, 72 of the three-way valve, and a downstream portion of the first fluid line 40 in fluid connection with an outlet 76, 66 of the three-way valve. As indicated in FIG. 1, first connection device 60 is located upstream the pump 44 of the first fluid line 40 and second connection device 70 is located downstream the pump 44 of the first fluid line 40 and upstream the multiple valve members 30.1, 30.2, 30.3, 30.4 and 30.5.

The second connection device 70 can be used to clean the multiple valve members 30.1, 30.2, 30.3, 30.4, and 30.5 of the valve unit 30, especially, the first inlets 34 of the multiple valve members, as well as a downstream portion of the first fluid line 40 by the dilution fluid. This can be done by arranging the first fluid line in flow connection with the source of dilution fluid 12. More particularly, by closing the first inlet 74 and opening the second inlet 72 of the second connection means 70, the dilution fluid from the second fluid line 42 is allowed to flow via the downstream portion of the first fluid line to the first inlets 34 of the valve unit 30. The first connection device 60 can correspondingly be used to clean also an upstream portion of the first fluid line 40, as well as the pump 44 in the first fluid line 40 by the dilution fluid. Usually, an arrangement 10 for feeding ammonia containing fluid into an exhaust gas passage comprises one of the first and second connection devices 60, 70, but it is also possible to have both the first and second connection devices 60, 70, as shown in FIG. 1.

Operation of the valve unit 30, i.e., the multiple valve members 30.1, 30.2, 30.3, 30.4, and 30.5, is advantageously controlled in any prevailing operating so as to reduce $NO_x$ emissions to a desired level by controlling the control unit by a control signal, which is preferably based on a binary logic. The multiple valve members are advantageously part of a distributed control system (DCS), so as to control the multiple valve members remotely by the distributed control system.

Figure 2:
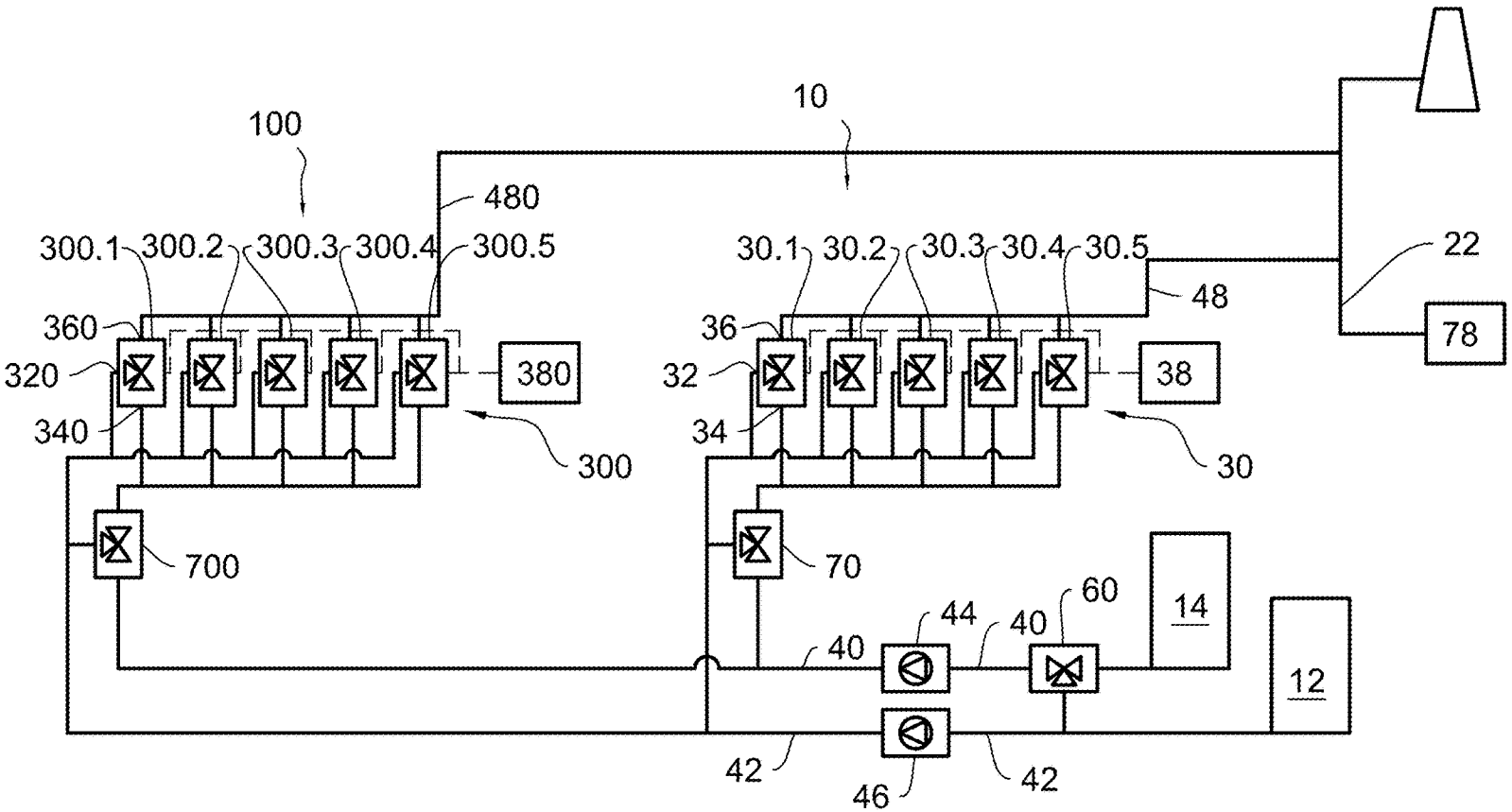
FIG. 2 schematically illustrates a combustion plant with arrangements for feeding ammonia containing fluid into an exhaust gas passage of the combustion plant according to an embodiment of the invention.

The schematic diagram of FIG. 2 illustrates a combustion plant 78 with arrangements 10, 100 for feeding ammonia containing fluid into an exhaust gas passage 22 of the combustion plant according to an embodiment of the invention. The first and second arrangements 10, 100 shown in FIG. 2 correspond mainly the arrangement 10 in FIG. 1. The reference numbers of the first arrangement 10 in FIG. 2 correspond to the reference number of the arrangement 10 in FIG. 1, and the reference numbers of the second arrangement 100 are formed by multiplying corresponding reference numbers of the arrangement 10 in FIG. 1 by 10.

The first and second feeding arrangements 10, 100 have common sources of ammonia containing fluid 14 and dilution fluid 12, common first 40 and second 60 fluid lines, which branch off to the individual feeding arrangements, and common pumps 44, 46 for maintaining a predetermined fluid pressure in the first and second fluid lines. Each branch of the first fluid line advantageously comprises its own connection devices 70, 700 to the second fluid line 60 to clean the respective feeding arrangement, as described in connection with FIG. 1. However, there is also connection device 60 upstream of the common pump 44 in the first fluid line 40 to enable simultaneous cleaning of the both ammonia feeding arrangements 10, 100.

The outlet channel 480 of the second feeding arrangement 100 is generally connected to the exhaust gas passage 22 at a different location than the outlet channel 48 of the first feeding arrangement. The connection locations can be, for example, at different heights in an exhaust gas channel, at different positions within a stage of the exhaust gas passage or at different stages of the exhaust gas passage. By using such versatile ammonia feeding systems, it is possible to accurately optimize the feeding of ammonia in different operating conditions of the combustion plant.

As becomes clear from above, an arrangement for and a method of feeding ammonia containing fluid into an exhaust gas passage of a combustion plant is applicable for a number of various applications and purposes. It should be understood that even though figures illustrate embodiments with the valve unit having five parallel valve members, the number of parallel valve members may in practice vary.

While the invention has been described herein by way of examples in connection with what are at present considered to be the most preferred embodiments, it is to be understood that the invention is not limited to the disclosed embodiments, but is intended to cover various combinations or modifications of its features and several other applications included within the scope of the invention as defined in the appended claims.

The invention claimed is:

1. An arrangement for feeding ammonia containing fluid into an exhaust gas passage of a combustion plant comprising:

a first fluid line connectable in flow connection with a source of an ammonia containing fluid;

a second fluid line in flow connection with a source of a dilution fluid; and an open flow path controller for controlling multiple valve members of a valve unit, each of the valve members having a first inlet in flow connection with the first fluid line, a second inlet in flow connection with the second fluid line and an outlet in flow connection with an outlet channel connected to the exhaust gas passage, the valve members being connected in parallel so that the outlet of each of the valve members is in flow connection with the outlet channel, wherein the open flow path controller is adapted for controlling each of the valve members to maintain an open flow path from either of the first inlet or the second inlet to the outlet, so as to feed a flow of either the ammonia containing fluid or the dilution fluid via the valve member to the outlet channel.

2. The arrangement according to claim 1, wherein each of the multiple valve members comprises a three-way valve.

3. The arrangement according to claim 1, wherein each of the multiple valve members has a specific throughput to feed a predefined flow of one of (i) the ammonia containing fluid and (ii) the dilution fluid via the valve member to the exhaust gas passage.

4. The arrangement according to claim 3, wherein each of the multiple valve members has a different specific throughput.

5. The arrangement according to claim 4, wherein the valve unit comprises N valve members numbered as 1, 2, 3, . . . , N, and having relative specific throughputs as 1, 2, 4, . . . , $2^{(N-1)}$.

6. The arrangement according to claim 1, wherein each of the first and second fluid lines is provided with a pump to maintain a pre-determined fluid pressure in the first and second fluid lines, respectively.

7. The arrangement according to claim 1, wherein between the first and second fluid lines is arranged a connector that provides the ability to temporarily arrange the first fluid line in flow connection with the source of dilution fluid.

8. The arrangement according to claim 7, wherein the connector comprises a three-way valve arranged in the first fluid line so as to have an upstream portion of the first fluid line in flow connection with a first inlet of the three-way valve, the second fluid line in flow connection with a second inlet of the three-way valve, and a downstream portion of the first fluid line in flow connection with an outlet of the three-way valve.

9. A combustion plant comprising:

at least one arrangement for feeding ammonia containing fluid into an exhaust gas passage of the combustion plant according to claim 1.

10. A method of feeding ammonia containing fluid into an exhaust gas passage of a combustion plant, the method comprising the steps of:

introducing an ammonia containing fluid from a source of an ammonia containing fluid into a first fluid line;

introducing a dilution fluid from a source of a dilution fluid into a second fluid line; and controlling multiple valve members of a valve unit with a control unit an open flow path controller, each of the valve members having a first inlet in flow connection with the first fluid line, a second inlet in flow connection with the second fluid line and an outlet in flow connection with an outlet channel connected to the exhaust gas passage, the valve members being connected in parallel so that each of the valve members is in flow connection with the outlet channel; and controlling each of the valve members by the open flow path controller to maintain an open flow path from either of the first inlet or the second inlet to the outlet, so as to feed a flow of either the ammonia containing fluid or the dilution fluid via the valve member to the outlet channel.

11. The method according to claim 10, wherein the ammonia containing fluid is ammonia solution in water and the dilution fluid is water.

12. The method according to claim 10, further comprising controlling the multiple valve members so as to control the ratio of the flow of the ammonia containing fluid and the flow of the dilution fluid in the outlet channel.

13. The method according to claim 12, wherein the multiple valve members comprise N valve members numbered as 1, 2, 3, . . . , N, and having relative specific throughputs as 1, 2, 4, . . . , $2^{(N-1)}$.

14. The method according to claim 10, further comprising the step of maintaining a predetermined fluid pressure in each of the first and second fluid lines by a pump.

15. The method according to claim 10, further comprising the step of cleaning the first inlet and the first fluid line by temporarily arranging the first fluid line in flow connection with the source of dilution fluid.

* * * * *